US006314275B1

(12) United States Patent
Pedersen et al.

(10) Patent No.: US 6,314,275 B1
(45) **Date of Patent: *Nov. 6, 2001**

(54) HAND-HELD TRANSMITTING AND/OR RECEIVING APPARATUS

(75) Inventors: Gert Frølund Pedersen, Storvorde; Jan Gert Thomsen, Aalborg, both of (DK)

(73) Assignee: Telit Mobile Terminals, S.p.A., Trieste (IT)

( * ) Notice: Subject to any disclaimer, the term of this patent is extended or adjusted under 35 U.S.C. 154(b) by 263 days.

This patent is subject to a terminal disclaimer.

(21) Appl. No.: 09/345,097

(22) Filed: Jun. 30, 1999

Related U.S. Application Data

(62) Division of application No. 08/915,308, filed on Aug. 19, 1997, now Pat. No. 5,952,975, which is a continuation of application No. 08/545,825, filed as application No. PCT/EP95/00813 on Mar. 6, 1995.

(51) Int. Cl.[7] ..... H01Q 1/38

(52) U.S. Cl. ..... 455/90; 343/700 MS; 343/831; 343/846

(58) Field of Search ..... 455/90, 89, 300, 455/344, 345, 346, 351, 567; 343/702, 700, 846, 829, 841, 843

(56) References Cited

U.S. PATENT DOCUMENTS

| | | | | |
|---|---|---|---|---|
| 4,167,010 | | 9/1979 | Kerr | 343/700 MS |
| 4,191,959 | | 3/1980 | Kerr | 343/761 X |
| 4,641,366 | | 2/1987 | Yokoyama et al. | 455/89 |
| 4,701,763 | * | 10/1987 | Yamamoto et al. | 343/700 |
| 4,876,709 | | 10/1989 | Rogers et al. | 379/61 |
| 4,980,604 | | 12/1990 | Hines | 343/702 |
| 4,980,694 | * | 12/1990 | Hines | 343/702 |
| 5,365,246 | * | 11/1994 | Rasinger et al. | 343/702 |
| 5,493,704 | * | 2/1996 | Grangeat et al. | 455/90 |
| 6,121,930 | * | 9/2000 | Grangeat et al. | 343/700 MS |
| 6,134,421 | * | 10/2000 | Lee et al. | 455/90 |
| 6,218,991 | * | 4/2001 | Sanad | 343/700 MS |
| 6,225,951 | * | 5/2001 | Holshouser et al. | 343/700 MS |

FOREIGN PATENT DOCUMENTS

| | | | |
|---|---|---|---|
| 0176311 | | 4/1986 | (EP) . |
| 0522538 | | 1/1993 | (EP) . |
| 2238665 | | 6/1991 | (GB) . |
| 405259725 | | 10/1993 | (JP) . |
| WO90/13152 | | 11/1990 | (WO) . |
| WO94/24743 | | 10/1994 | (WO) . |
| 94/24723 | * | 10/1994 | (WO) H01Q/1/24 |

* cited by examiner

*Primary Examiner*—Daniel Hunter
*Assistant Examiner*—Pablo Tran
(74) *Attorney, Agent, or Firm*—Wood, Herron & Evans, LLP.

(57) ABSTRACT

A hand-held transmitting and/or receiving apparatus has an elongated housing, an electric circuit inside the housing, an earphone at one side and one end of the housing, an electric ground plane at the other side of the housing opposite to the earphone, an antenna resonator element arranged approximately parallel to the ground plane and having a first free and a second end which is electrically connected by a ground connector to the ground plane and means for connecting the ground plane and the resonator element to the electric circuit. The free end of the resonator element points to the end of the housing. By this the strength of the electrical field of the antenna near the hand or the head of the user is low. This lowers health risk and influences on the hand or the body of the user on the electric parameters of the antenna.

20 Claims, 2 Drawing Sheets

HAND-HELD TRANSMITTING AND/OR RECEIVING APPARATUS

This application is a Divisional of a prior application Ser. No. 08/915,308, filed on Aug. 19, 1997, now U.S. Pat. No. 5,952,975, which is a Continuation of Ser. No. 08/545,825, filed on Nov. 8, 1995 now abandoned, which is National Phase under 35 USC §371 of PCT/EP95/00813, filed on Mar. 6, 1995, which claims priority under 35 USC §119 from Denmark Application No. 0267/94, filed Mar. 8, 1994.

BACKGROUND OF THE INVENTION

1. Field of the Invention

The invention relates to a hand-held transmitting and/or receiving apparatus comprising an elongated housing, an electric circuit inside the housing, an earphone at one side and one end of the housing, an electrical ground plane at the other side of the housing opposite to the earphone, an antenna resonator element arranged approximately parallel to the ground plane and having a first free and a second end which is electrically connected by a ground connector to the ground plane and means for connecting the ground plane and the resonator element to the electrical circuit.

2. Description of the Prior Art

An apparatus of this kind is disclosed in Japanese patent application 63-86 559. The antenna is an inverted F-antenna. The antenna resonator element of this antenna is connected to the ground plane by a ground connector at the end of the housing where the earphone is positioned. Therefore the free end of the antenna points away from this end of the housing and extends to the middle of the housing where the hand of the user holds the apparatus. From this follows that the hand of the user not only influences the field of the antenna and the radiation pattern accordingly but also the resonance frequency, the impedance and the gain of the antenna. As a result of the mismatching standing waves on the feedline to the antenna appear resulting in a loss of high frequency power.

A further disadvantage of this known antenna results from the fact that the centre of the head of the user is near to the maximum of the strength of the electrical field of the antenna. This results in additional losses of the radiation energy when the antenna is used as a transmitting antenna but results also in influences of the electrical field to the head of the user so loading the head with health risks.

The object of the invention is to overcome the disadvantages of the state of the art namely to avoid influences from the hand or head of a user of the hand-held transmitting and/or receiving apparatus on the antenna and vice versa.

SUMMARY OF THE INVENTION

The basic idea of the invention is to turn the known antenna by 180° so that the free end of the antenna is pointing to the end of the housing where the earphone is positioned. Therefore the maximum of the electrical field of the antenna is as far away from the user as possible, especially from his hand and his head so that the mutual influence is minimum. This means a lower influence on the electrical parameters of the antenna, especially impedance, gain and effectively. On the other side the risks on the health of the user are minimized.

According to one embodiment of the invention the ground plane extends over approximately the whole width of the elongated housing. This assists in achieving a radiation pattern having the maximum or maxima away from the head of the user.

According to a further embodiment of the invention the resonator element has approximately the same width and radiation pattern.

To this also adds a further improvement of the basic idea of the invention according to which the ground connector extends over the whole width of the resonator element.

According to a further improvement an elongated feeder element is provided positioned at one side of the resonator element for coupling the feeder element to the resonant element, one end of the feeder element representing a feeding end coupled to the means for connecting the resonator element to the electric circuit. This improvement avoids a galvanic contact between the electric circuit and the resonator element. Preferably the feeder element extends over approximately the whole length of the resonator element. By this an electromagnetic coupling is achieved. Additionally the feeding end of the feeder element can be positioned at the free end of the resonant element.

According to one improvement of the invention a projection is provided at the edge of the free end of the resonator element the projection having a smaller width than the resonator element. By adjusting the length of the projection the resonant frequency of the resonator element can be tuned. Preferably, the width of the projection is ten times or more less than the width of the resonator element. By this dimensioning of the projection a fine tuning of the resonator element is possible.

According to one improvement of the invention the resonator element and the ground plane are in the form of an electrically conducting layer or coating on a dielectric substrat. By this airgaps between the resonator element and the ground plane are avoided which may be influenced by mechanical forces, temperature or the like which could change the electrical parameters of the antenna. Preferably the dielectric substrat is the housing or a part of the housing. More preferably the dielectric substrat is a separate unit connected to or positioned inside the housing made from nonconducting material. The ground connector may comprise one single ground connector element extending over the whole width of the resonator element or may comprise at least two ground connector elements distributed over the width of the resonator element.

BRIEF DESCRIPTION OF THE DRAWINGS

In the following the invention will be described in more details by way of examples shown in the drawings in which.

DETAILED DESCRIPTION

Figure 1:
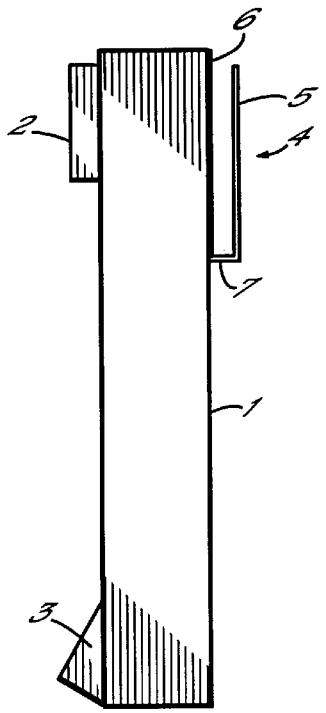
FIG. 1 is an elevational view of one example of a hand-held transceiver for a wireless telephone.

FIG. 1 is a side view of a hand-held transceiver comprising a housing 1, an earphone 2, a microphone 3 and an antenna 4 consisting of an resonator element 5, a ground plane 6 and a ground connector 7 connecting one end of the resonator element 5 to the ground plane 6.

The resonator element 5, the ground connector 7 and the ground plane 6 are in the form of a metallic sheet. The ground plane 6 is connected to the backside of the housing 1.

Figure 2:
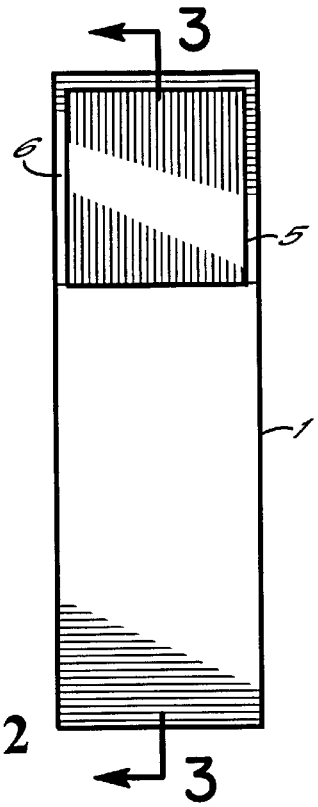
FIG. 2 is a view on the backside of the transceiver according to FIG. 1.

As can be best seen from FIG. 2 the width of the ground plane 6 is the same as the width of the housing 1, and the width of the resonator element 5 also has almost the same width as the housing 1. The means for feeding the resonator element 5 and for connecting it and the ground plane 6 to the circuit inside the housing 1, namely a transmitter and a receiver, are not shown and may have any form known in the state of the art. E.g., a coax-cable can be connected to the ground plane the core of the cable being connected to the resonant element 5 at a distance away from the ground connector 7.

As can be best seen from FIG. 1 the free end of the resonant element 5 points in the direction to the end of the housing 1 carrying the earphone 2. Therefore the strength of the electrical field generated by the resonant element 5 has its maximum away from the area where the hand of a user grips the housing 1, namely between the earphone 2 and the microphone 3. The strength of the electrical field near the ground connector 7 is low. The result is that the influence of the hand of the user on the antenna 4 is low. Furthermore the maximum of the electrical field of the antenna at its free end is as far away from the head of the user as possible when the earphone 2 contacts the ear of the user.

Figure 3:
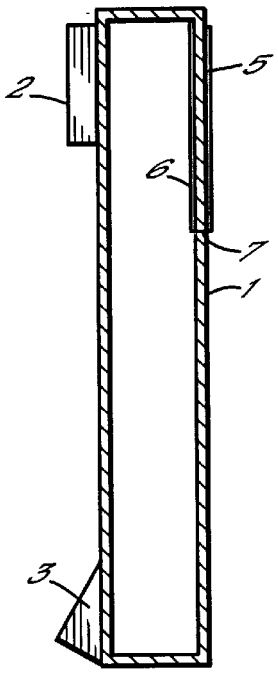
FIG. 3 is a section III—III through FIG. 2.

FIG. 3 shows another example in cross section almost similar to a section III—III through FIG. 2. Similar items have the same reference numbers. Different from the example shown in FIGS. 1 and 2 is the positioning of the ground plane 6 which now is inside the housing 1 while the resonant element 5 is outside of the housing 1 the ground connector extending through a slit in the wall of the housing 1. Ground plane 6 and resonator element 5 are in the form of conducting layers on the wall of the housing 1 which wall is made from a dielectric material. Since there is no air gap between the resonant element 5 and the ground plane 6 on the one hand and the dielectric material of the wall of the housing 1 on the other hand the electric parameters of the antenna are highly independent from mechanical forces on the antenna 5 and/or the groundplane 6.

Figure 4:
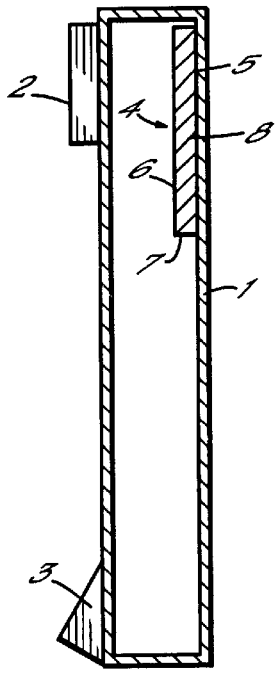
FIG. 4 is a view similar to FIG. 3 showing a second example.

FIG. 4 shows an example in a form similar to FIG. 3. Similar items carry the same reference number. In FIG. 4 the antenna element 5, the ground plane 6 and the ground connector 7 are conducting layers on a separate dielectric substrate 8 altogether forming an independent unit which is fixed to the inner wall of the housing 1. This avoids a slit through the wall of the housing 1 for the ground connector 7 connecting the foot of the resonator element 5 to the ground plane 6. Since all electric elements of the antenna in this example are inside the housing 1 it is easier to connect the electric elements of the antenna to the electric circuit inside the housing 1.

Figure 5:
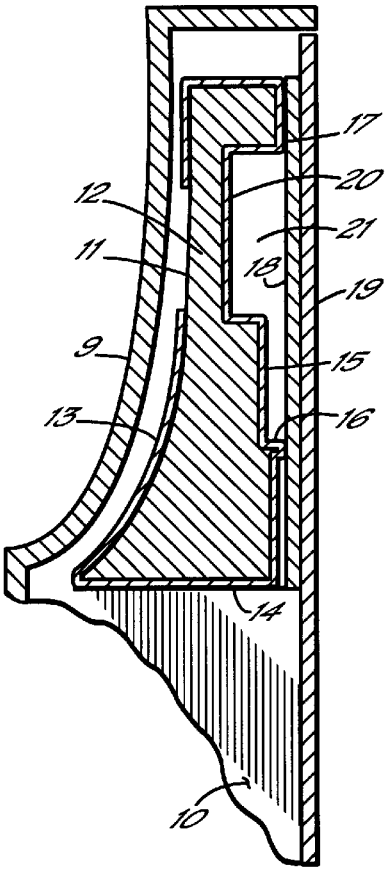
FIG. 5 is a sectional view through a third example similar to the upper part of FIG. 4

FIG. 5 shows in more details a sectional view through the upper part of a hand-held apparatus with an antenna arrangement similar to that of FIG. 4. Inside a wall 9 of a housing 10 most of which is broken away an antenna unit 11 is positioned consisting of a dielectric body 12 on which in form of electric layers an antenna resonator element 13, a ground connector 14 and a ground plane 15 are fixed. The ground plane 15 has protrusions 16 and 17 contacting a con ducting elastic layer 18 on a circuit board 19 carrying the electrical leads and elements not shown in known manner.

The dielectric body 12 has a recess 20 so providing a cavity 21 into which circuit elements on the circuit board may extend which are so well-screened by the electric layer of the ground plane 15.

Figure 6:
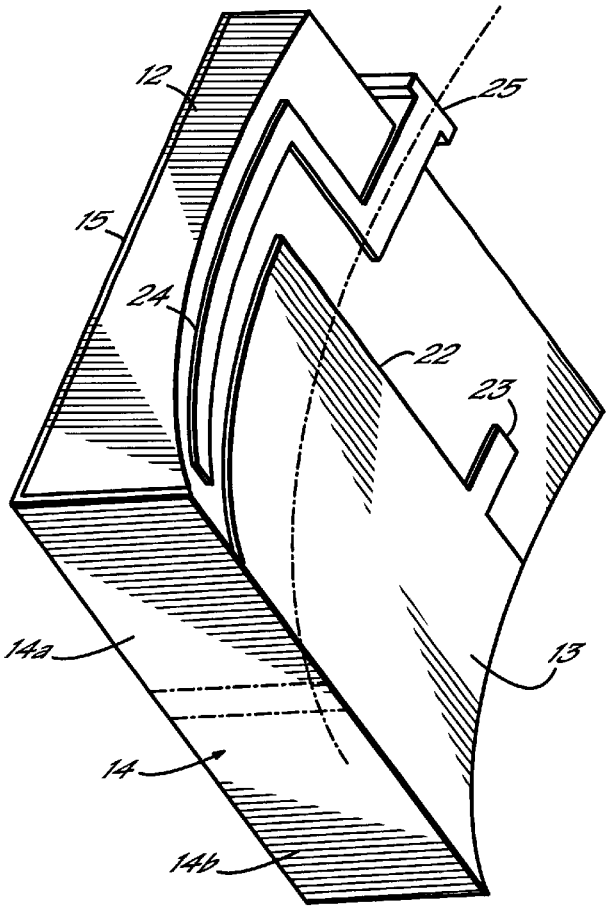
FIG. 6 is a perspective view of the antenna unit in FIG. 5.

FIG. 6 shows the unit comprising the dielectric body 12, the resonant element 13, the ground connector 14 and the ground plane 15 in perspective view. It can be seen that from an edge 22 of the free end of the resonant element 13 a projection 23 extends the width of which is much smaller than the width of the resonant element 13. The projection 23 can be shortened for tuning purposes.

In FIG. 6 furthermore can be seen that at one side of the resonant element 13 a feeder element 24 is fixed on the surface of the dielectric body 12, said feeder element 24 extending approximately over the whole length of the resonator element 13. The free end of the feeder element 24 is near the ground connector 14 while another end 25 of the feeder element 24 extends to that side of the dielectric body 12 where the ground plane 15 is located. Therefore the feeder element 24 can be connected to the electric leads of the circuit board 19 by a small conducting and elastic layer just in the same manner as the ground plane 15 is connected to the circuit board 19 by the layer 17.

What is claimed is:

1. A hand-held radio transceiver comprising:

a housing having a top end and a bottom end, and front and rear sides extending between the top and bottom ends;

an earphone disposed on the housing front side adjacent the top end thereof;

an antenna system extending along the housing rear side and having a ground plane disposed generally opposite the earphone and a resonant element extending along a resonator plane generally parallel to the ground plane, the resonant element having a grounding end spaced away from the housing top end and a free edge extending from said grounding end toward the housing top end, and a ground connector extending between and electrically connecting the ground plane to the resonant element grounding end;

an electric circuit within the housing being electrically connected to the antenna system;

the housing of said transceiver terminating short of a region opposite to said resonant element free edge along the direction of said resonator plane, whereby signals tend to radiate from the resonant element upwardly and away from the earphone.

2. The hand-held radio transceiver of claim 1, wherein said free edge of said resonant element is adjacent to said housing top end.

3. The hand-held radio transceiver of claim 1, wherein said antenna system further comprises a dielectric body, and said ground plane, resonant element and ground connector of said antenna system comprise electrically conductive layers on said dielectric body.

4. The hand-held radio transceiver of claim 1, wherein said housing rear side has a width and said ground plane has a width substantially equal to the width of said housing rear side.

5. The hand-held radio transceiver of claim 1, wherein said ground plane has a width and said resonant element has a width substantially equal to the width of said ground plane.

6. The hand-held radio transceiver of claim 1, wherein said resonant element has a width and said ground connector has a width substantially equal to at least one-half the width of said resonant element.

7. The hand-held radio transceiver of claim 1, further comprising a second ground connector, said first and second ground connectors being distributed over the width of said grounding end of said resonant element.

8. The hand-held radio transceiver of claim 1, further comprising an elastic, electrically conductive element positioned between said electric circuit and said ground plane and forming an electrical connection therebetween.

9. The hand-held radio transceiver of claim 1, wherein said resonant element of said antenna system further comprises a tuning stub projecting from said free edge, said tuning stub having a width smaller than a width of said free edge, and further comprising a feeder element electrically connecting the resonant element to the electric circuit.

10. The hand-held radio transceiver of claim 1, wherein said resonant element has an arcuate surface contour.

11. A hand-held radio transceiver comprising:

a housing, an electric circuit within the housing, an antenna system extending along the housing and having a ground plane, a resonant element extending generally parallel to the ground plane, the resonant element having a free edge, a ground connector extending between and electrically connecting the ground plane to the resonant element at a location distal from said free edge, a feeder element electrically connecting the resonant element to the electric circuit, and a tuning stub projecting from said free edge, said tuning stub having a width smaller than a width of said free edge.

12. The hand-held radio transceiver of claim 11, wherein said antenna system further comprises a dielectric body, and said ground plane, resonant element, ground connector and tuning stub of said antenna system comprise electrically conductive layers on said dielectric body.

13. The hand-held radio transceiver of claim 11, wherein said housing is electrically non-conductive, and said antenna system is positioned inside of said housing.

14. The hand-held radio transceiver of claim 11, wherein said housing rear side has a width and said ground plane has a width substantially equal to the width of said housing rear side.

15. The hand-held radio transceiver of claim 11, wherein said ground plane has a width and said resonant element has a width substantially equal to the width of said ground plane.

16. The hand-held radio transceiver of claim 11, wherein said resonant element has a width and said ground connector has a width substantially equal to at least one-half the width of said resonant element.

17. The hand-held radio transceiver of claim 11, wherein said resonant element has a width and said tuning stub has a width substantially one tenth the width of said resonant element.

18. The hand-held radio transceiver of claim 11, further comprising a second ground connector, said first and second ground connectors being distributed over the width of said resonant element.

19. The hand-held radio transceiver of claim 11, further comprising an elastic, electrically conductive element positioned between said electric circuit and said ground plane and forming an electrical connection therebetween.

20. The hand-held radio transceiver of claim 11, wherein said resonant element has an arcuate surface contour.

* * * * *